United States Patent [19]

Box

[11] 4,044,910

[45] Aug. 30, 1977

[54] COLLAPSIBLE CRATE

[76] Inventor: Theodor M. Box, 1108 Aileen Road, Brielle, N.J. 08730

[21] Appl. No.: 683,390

[22] Filed: May 5, 1976

[51] Int. Cl.[2] ..... B65D 7/24; B65D 9/14

[52] U.S. Cl. ..... 220/7; 217/15; 217/47; 220/6

[58] Field of Search ..... 220/7, 6, 4 F, 1.5, 220/75, 76; 217/13, 15, 45, 47

[56] References Cited

U.S. PATENT DOCUMENTS

| | | | |
|---|---|---|---|
| 1,156,230 | 10/1915 | Holbrook | 217/15 |
| 2,486,532 | 11/1949 | Kuback | 220/6 X |
| 3,955,703 | 5/1976 | Zebarth | 220/7 X |

*Primary Examiner*—William Price
*Assistant Examiner*—Steven M. Pollard

[57] ABSTRACT

A collapsible crate for shipping produce and the like comprising a base portion, two inwardly folding end-wall members and two inwardly folding side-wall members. Each wall member is divided into an upper and lower portion by means of a unitary hinge, wherein the lower portions of the wall members are fixably attached to vertical flanges which extend from the base portion. The vertical edges of the upper portions of the wall members are provided with a plurality of stops and latches which hold the wall members in an upright engaged position when the crate is assembled.

7 Claims, 14 Drawing Figures

Fig.4.
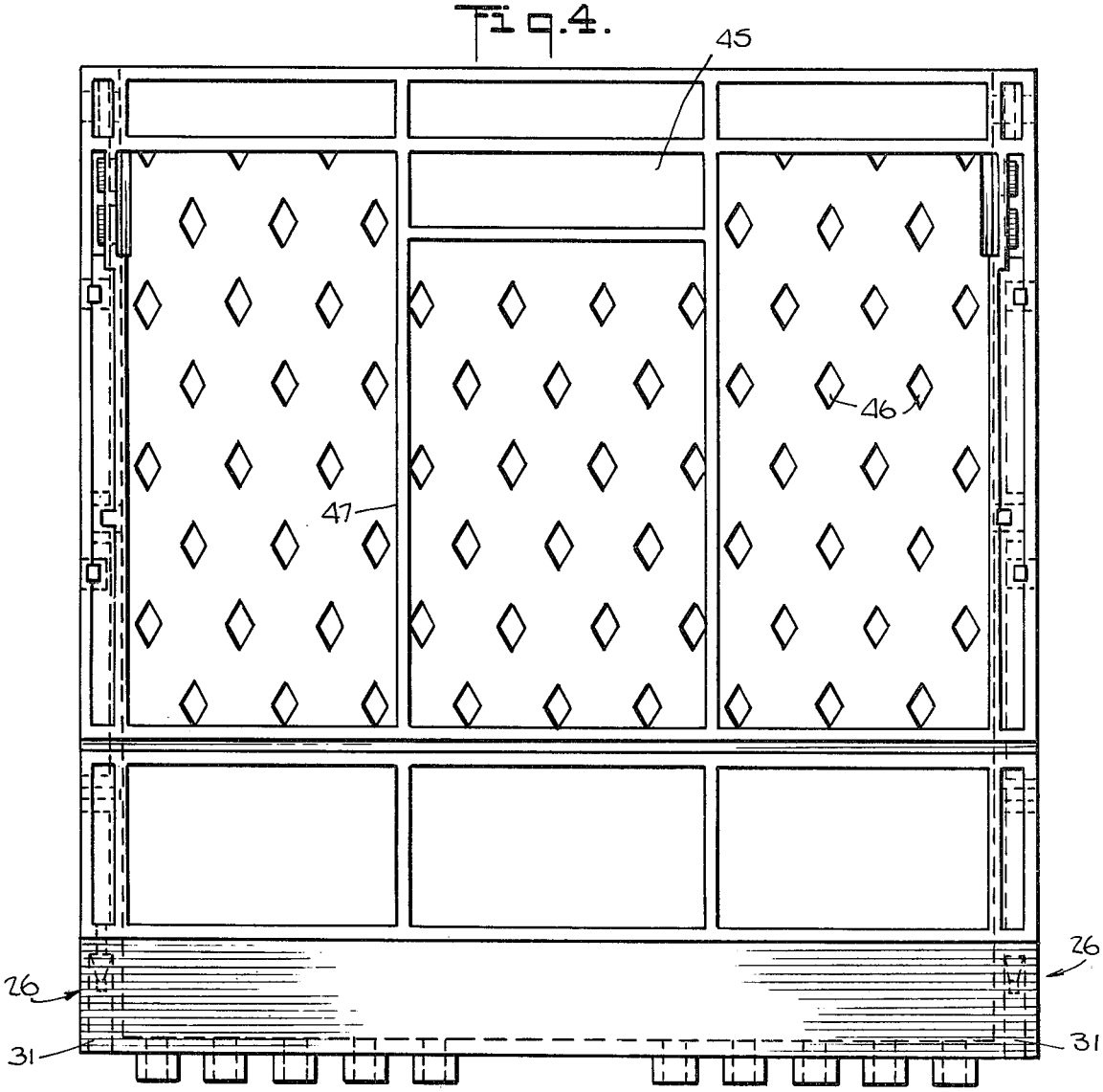
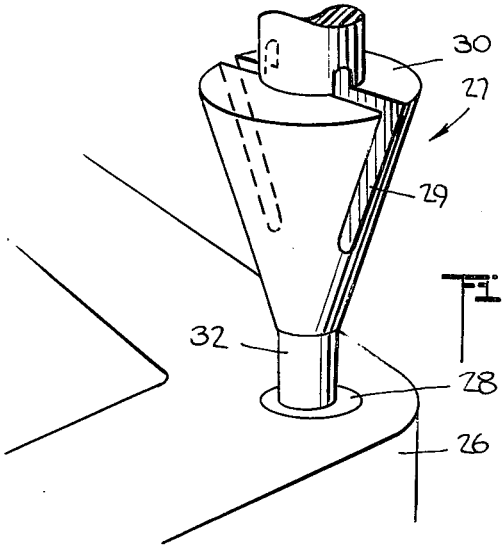
Fig.10.
Fig.9.
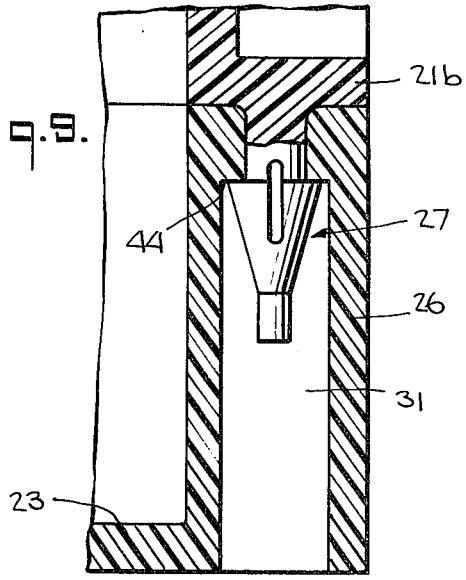

40
41
42
43
32
33
34
35
36
37
38
39
21
22
22a
22b
23
24

COLLAPSIBLE CRATE

DESCRIPTION OF THE PRIOR ART

In the past a variety of collapsible containers have been developed for use in the transportation and storage of fruit and vegetables. Many of these prior art containers have sides that are connected to a bottom member by hinges such that they fold outward into a flat, collapsed condition when not in use. The main disadvantage of this type of container is that it requires substantially larger floor space in its folded position, than in its assembled condition, thereby making storage and stacking cumbersome.

Other prior art containers utilize end and sidewalls that fold inwardly thereby to an extent overcoming the above-mentioned disadvantages. An example of this type of box is disclosed in U.S. Pat. No. 3,628,683 issued on Dec. 21, 1971. This patent discloses a collapsible box whose inwardly folding wall members are attached at their lower edge to the bottom section of the box by means of hinges. These walls are held in their upright assembled position by means of a series of cooperating pegs and slots located along the edges of the wall members.

Although overcoming many of the disadvantages encountered with the prior art boxes having outwardly collapsing walls the just mentioned box is adapted with a number of individual hinges which, although being functionally satisfactory, are difficult and relatively expensive to assemble during fabrication. Furthermore, the hinges do not extend the entire length of the wall members thus decreasing the overall strength of the box.

Unlike the prior art devices the crate of the present invention is adapted with inwardly folding wall members that are of a unitary construction with the hinge portion, thereby decreasing the time and cost of production while increasing the strength of the container by providing for a hinge which extends the entire length of the wall member.

SUMMARY OF THE INVENTION

The present invention relates to a collapsible fruit or vegetable crate which comprises a base member and a plurality of four inwardly folding wall members attached thereto. The four wall members comprise two end-wall members and two side-wall members, each wall member having a series of latches along its vertical edges to hold the wall members in an upright locked position when the crate is assembled for use. The four wall members are also provided at their lower portions with unitary hinges that extend the entire width of each wall, thereby dividing each wall member into an upper wall portion and a lower wall portion. Each lower wall portion is unitarily molded along its lower edge to the bottom of the crate.

Accordingly it is an object of the present invention to provide a collapsible crate which is portable and easy to use.

Another object of the invention is to provide a collapsible crate whose side and end-walls fold inwardly.

A further object of the invention is to provide a collapsible crate having a structure that can easily and inexpensively be produced.

Another object of the present invention is to provide a collapsible crate whose hinge and wall members are of unitary construction for ease and economy of production as well as strength.

Still another object of the present invention is to provide a collapsible crate which can quickly and easily be assembled and disassembled.

Still other objects and advantages of the present invention will be obvious and in part be apparent from the specification and attached drawings.

DESCRIPTION OF THE DRAWINGS

For a fuller understanding of the invention reference is had to the following description taken in connection with the accompanying drawings of the preferred embodiment in which:

FIG. 4 is an end elevation of the container of FIG. 3;

FIG. 9 is a partial vertical section view of the means for locking the end and side-walls to the base portion of the present invention showing the plug in its inserted position;

FIG. 10 is a perspective view of the plug portion of the locking means shown in FIG. 9;

DESCRIPTION OF THE PREFERRED EMBODIMENT

Figure 1:
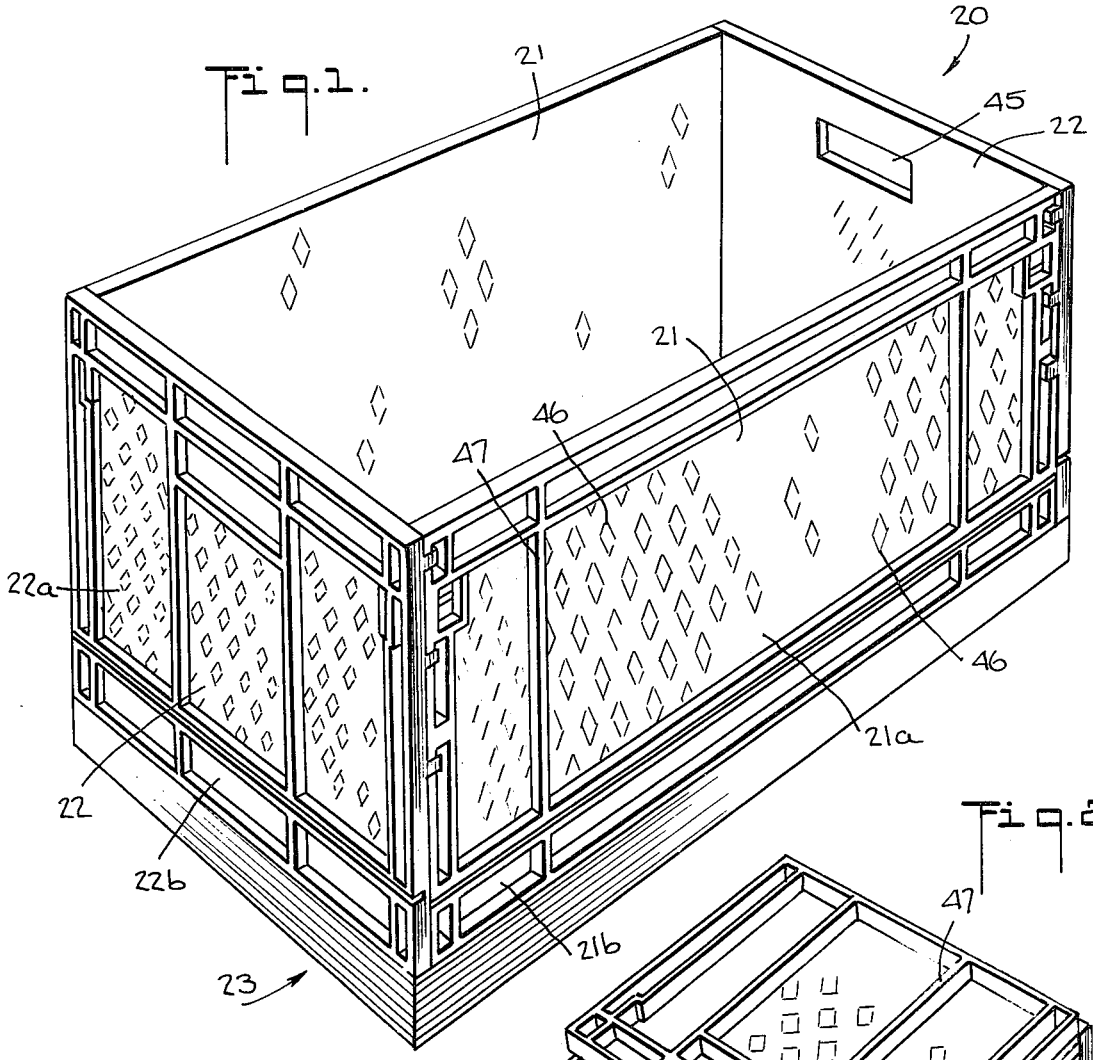
FIG. 1 is an isometric view of the collapsible container in its fully assembled condition.

As shown in the drawings, the collapsible crate of the present invention comprises essentially four inwardly folding wall members fixably attached to respective base portions. Each of these wall members is provided on its vertical side edges with a plurality of cooperative stops and latches adapted to lock the wall members in an upright position when the crate is assembled.

Referring now more particularly to the accompanying drawings, wherein like numerals designate similar parts throughout the various views, attention is directed first to FIG. 1, wherein a crate designated generally by reference numeral 20 of the present invention, has side-wall members 21, end-wall members 22 and bottom 23 as shown. As can readily be seen from FIG. 2 the end-wall members 22 are divided by means of a unitary hinge 24, which extends the entire length of end-wall member 22, into an upper portion 22*a* and a lower portion 22*b*. Side-wall members 21 are similarly divided into an upper portion 21*a* and a lower portion 21*b* by means of unitary hinge 25.

Figure 3:
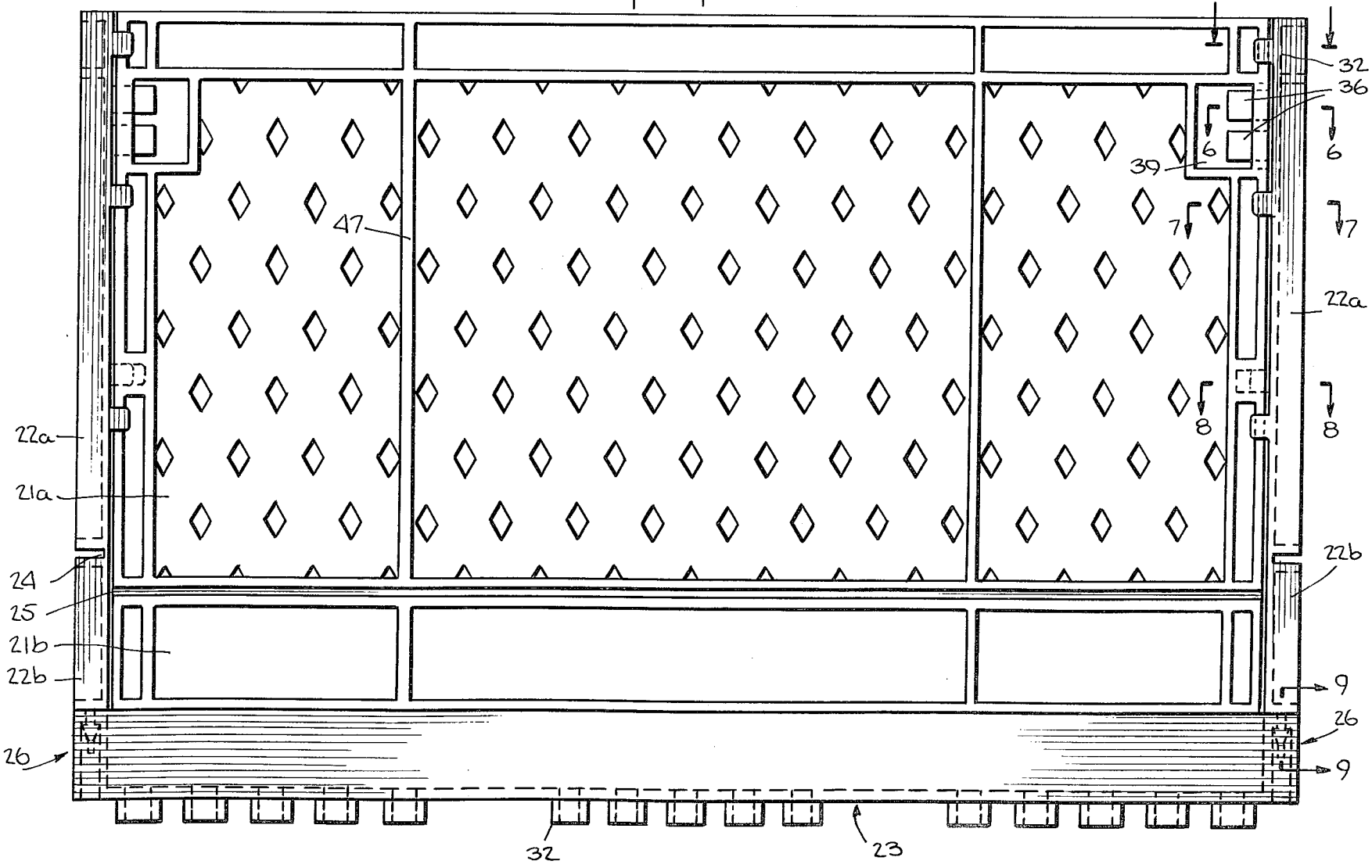
FIG. 3 is an enlarged side elevation of the container in assembled condition.

Referring to FIG. 3 and 4, vertical flanges 26 extend from the periphery of the base portion 23 and are molded as an integral part thereof.

The lower wall portions 21*b* and 22*b* of wall members 21 and 22 respectively, are fixably attached to the top edge of vertical flanges 26 by means of a plurality of plugs 27 (shown in FIG. 9 and 10) which extend from the bottom edges of the lower wall portions 21*b* and 22*b* at predetermined spaces. These plugs engage sockets 28 located along the upper edge portions of the vertical flanges 26. As shown in FIG. 9 plug 27 is provided with a slit 29 which permits plug 27 to radially compress, so that it may be forced through socket 28. Plug 27 is also adapted with a pilot 32 which serves to allign the plug 27 with socket 28 when assembling the crate. Once plug 27 is inserted through the socket 28 shoulder 30 located on the plug contacts shoulder 44 of socket 28 thus preventing plug 27 and the respective wall members, from which it extends, from being detached from the base portion 23.

Located on the bottom side of base portion 23 are a plurality of hollow drainage feet 32, these feet serve a two fold purpose in that they are adapted not only to engage the upper edges of another box to facilitate stacking but they also serve as drainage outlets for any juice which may be squeezed from the fruit during shipping.

Figure 2:
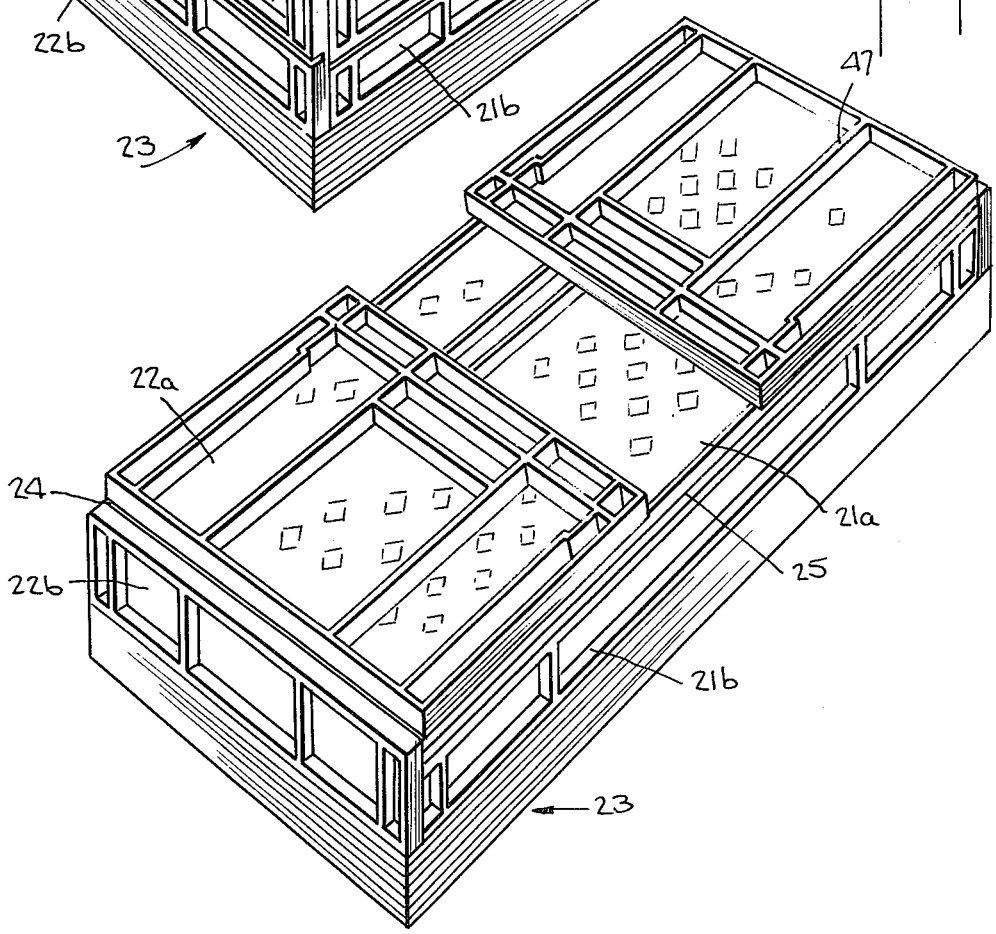
FIG. 2 is an isometric view of the collapsible container in its folded condition.
Figure 13:
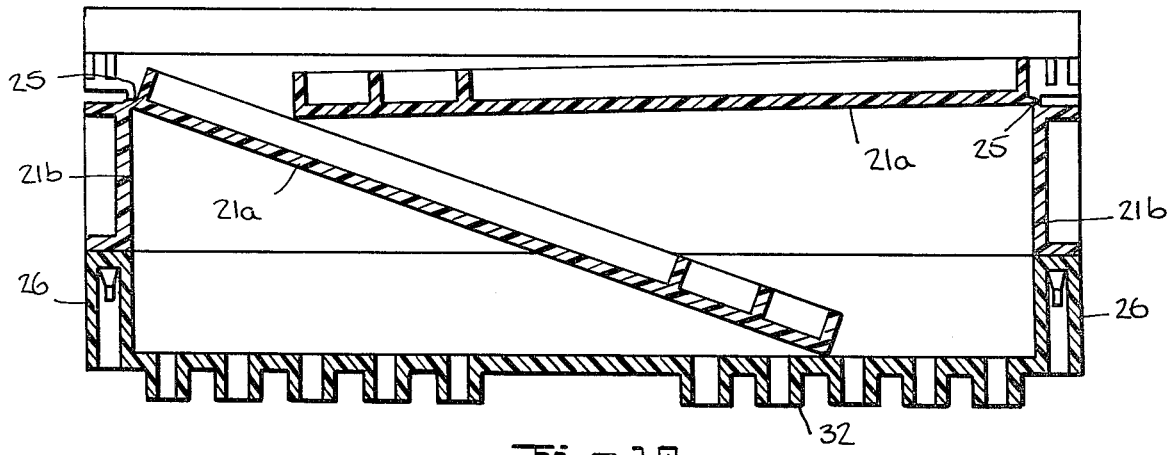
FIG. 13 is an end vertical section view showing the preferred embodiment in the collapsed position.

As shown in FIG. 3 the lower wall portion 22*b* extends from the vertical flanges 26 to a greater height than lower wall portion 21*b,* resulting in unitary hinge 24 being located in a higher plane than hinge 25. This arrangement allows the upper end-wall member 22*a* to be folded down to rest upon and overlie the upper side-wall members 21*a* when all the upper wall member portions are in a collapsed position, as illustrated in FIGS. 2, 13 and 14.

Located along the vertical edges of the upper wall members 21*a* and 21*b* are a plurality of stops and latches adapted to hold the four wall members in the erected position when the crate is assembled.

Figures 5, 6, 7, 8, 14:
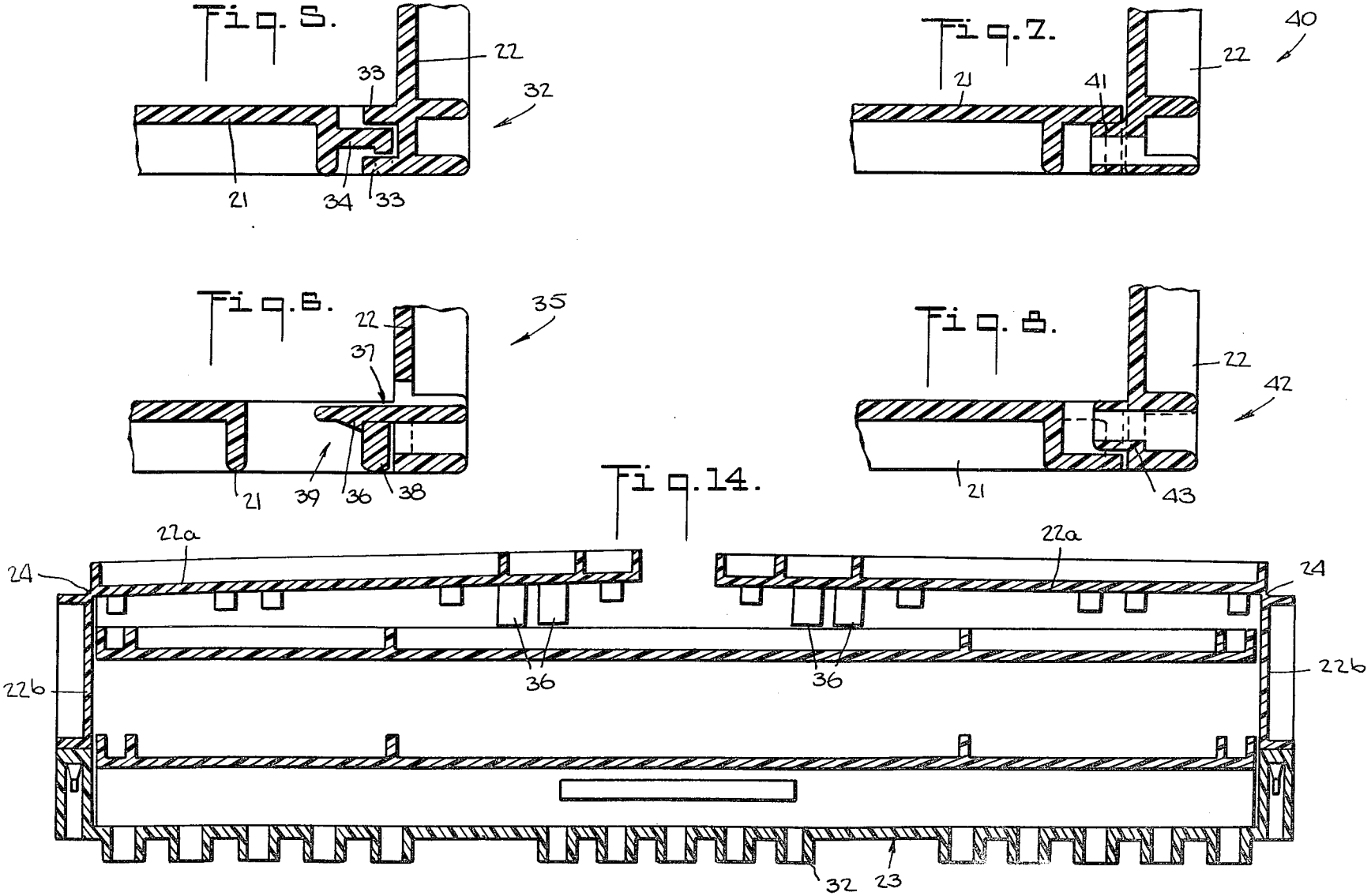
FIG. 5 is a fragmentary sectional view taken along line 5—5 in FIG. 3 showing the first stop means.
FIG. 6 is a fragmentary sectional view taken along line 6—6 in FIG. 3 showing the latching means.
FIG. 7 is a fragmentary sectional view taken along line 7—7 in FIG. 3 showing the second stop means.
FIG. 8 is a fragmentary sectional view taken along line 8—8 in FIG. 3 showing the third stop means.
FIG. 14 is a longitudinal elevation in section showing the preferred embodiment in the collapsed position.

FIG. 5 depicts the double stop 32 located on the upper position of the vertical edges of wall members 21 and 22. The inner edge of end-wall 22 is provided with stop members 33 which prevent the side-wall member 21 from inward or outward movement subsequent to the placement of rib portion 34 between stop members, 33. This stop does not, however, prevent the end-wall 22 from being moved outwardly.

Referring to FIG. 6, double latch means 35 is shown. This latching means, like the first stop means 32 described above, is also positioned on the vertical edges of wall members 21 and 22 however unlike stop means 32 latch 35 is capable of locking the end and side-wall members in an upright position. Latch 35 consists of snap fingers 36 which are located on end-walls 22 and are adapted to engage rectangular sockets 37 located on the edge rib 38 of side-wall 21. An open portion 39 is provided on side-wall 21, where snap fingers 36 protrude from the edge rib 38, so that, in disassembling the crate snap fingers 36 may be pushed inwardly thereby disengaging the end-wall members from the side-wall members.

FIG. 7 depicts single stop 40 which prevents side-wall 21 from outward movement, once side-wall 21 has come into contact with stop lug 41 located on the inner edge of end-wall 22.

FIG. 8 depicts another single stop, 42. This stop prevents side-wall 21 from inward movement once side-wall 21 has come into contact with stop lug 43 located on the inner edge of end-wall 22.

Figure 11:
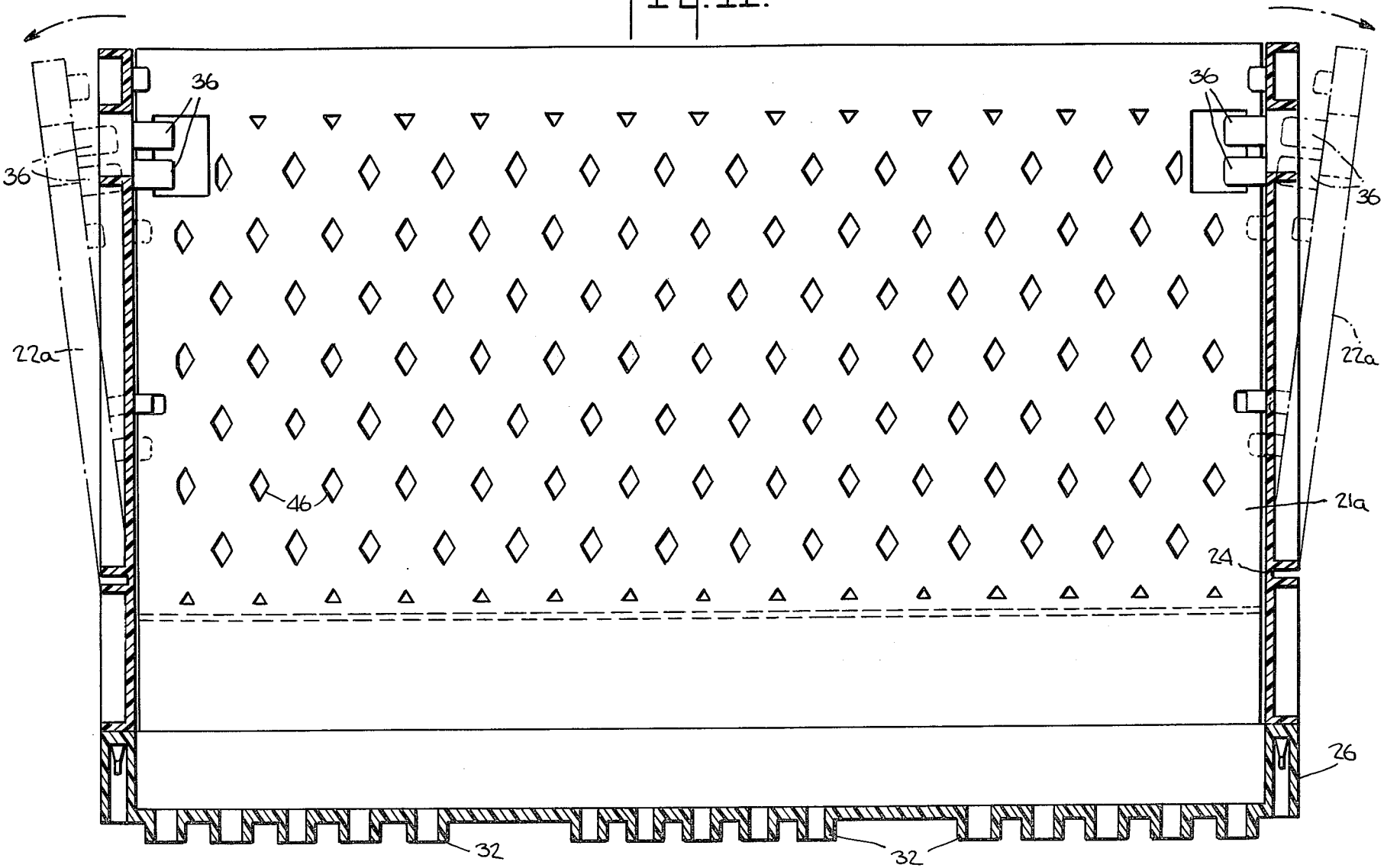
FIG. 11 is a side view of the preferred embodiment showing the end-walls folded slightly outward such that the side-walls may be brought to an upright position prior to the engagement of latching means.

In assembling the crate of the present invention end-walls 22 are folded slightly outwardly, as shown in FIG. 11 such that snap fingers 36 permits the side-wall 21 to be raised to their vertical position.

End-walls 22 are then moved inward so that the snap fingers engage their respective sockets located in the vertical edges of end-wall members 21.

Figure 12:
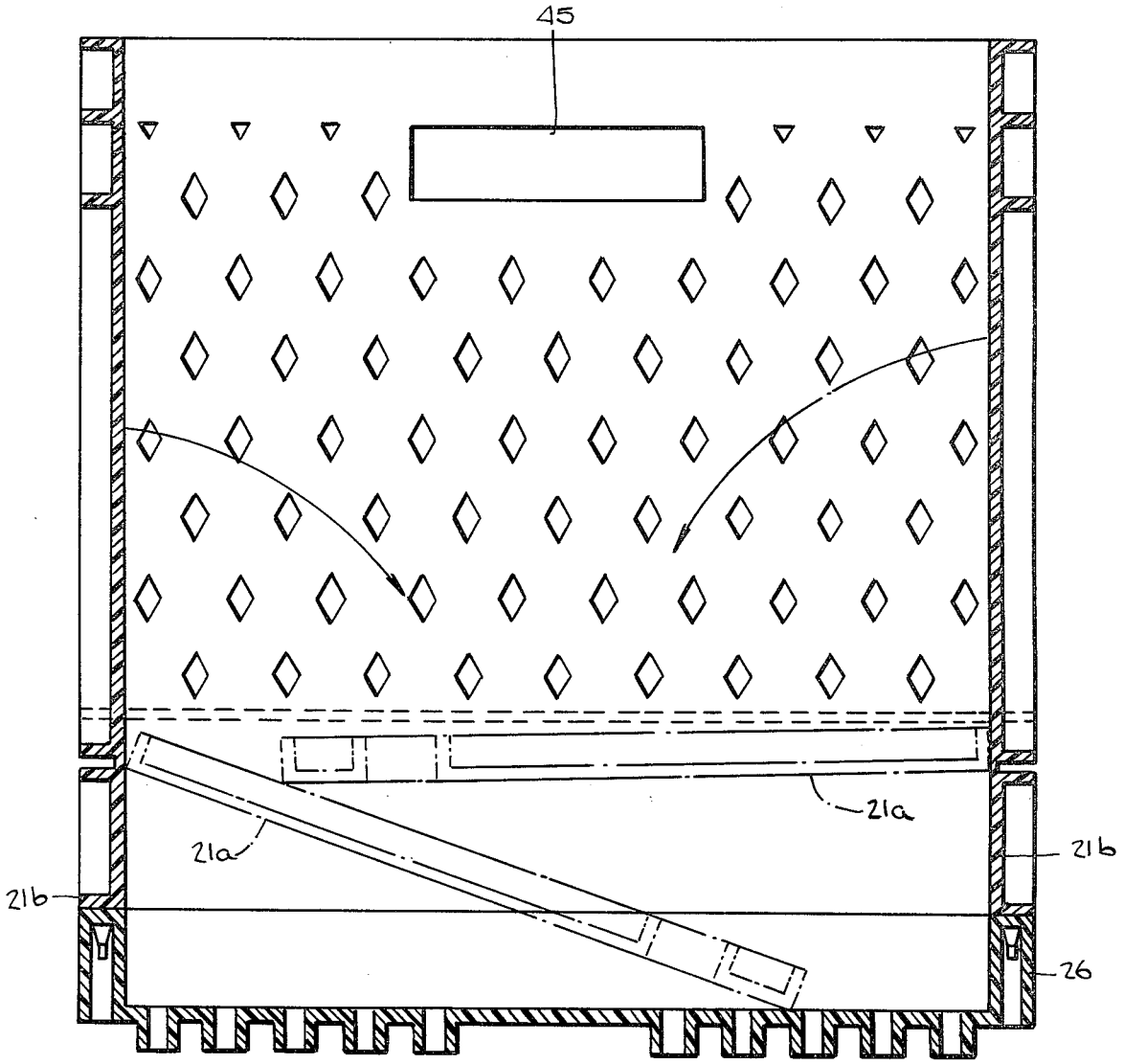
FIG. 12 is an end vertical section view showing both side-walls in the folded position and the end-walls in the erect position.

To disassemble the crate of the present invention snap fingers 36 are moved inwardly such that they disengage ribs 38 located on the side-walls 21. The end-wall members are then moved sli,htly outwardly so that the snap fingers 36 allow the side-wall member 21 to be folded inward, as shown in FIG. 12. End-wall members 22 are then folded down on top of the side-wall members 21 as shown in FIGS. 13 and 14.

Hinges 24 and 25 as shown in the drawings are of a unitary construction with the upper and lower wall members. As would be understood by one skilled in the art, this hinge is effected at the time of production of the wall members by "coining" or by heating indenting and subsequently annealing the adjoining wall portion. This unitary or "living " hinge extends the entire length of each wall member thereby adding strength and durability to the hinged area.

In the particular embodiment of the present invention, shown in the drawings, end-wall members 22 are depicted as having apertures 45 which serve as handles to facilitate the handling of the crates. This embodiment is also adapted with a multiplicity of apertures 46 which not only serve to ventilate but also aid in the viewing of the crates contents when the crates are stacked one upon the other. Bracing ribs 47, which are molded as integral parts of the individual members, increase the overall strength of the crate while not substantially adding to the overall weight.

Although the crate of the present invention may be constructed of a variety of different materials, one should keep in mind when selecting the material to be used the stresses to which the crate will be subjected to, as well as the ease in which the material can be molded or formed into the various parts.

The use of a plastic resin such as polystyrene is convenient for the construction of the crate since it is easily molded and of a sufficient strength to withstand the ordinary use to which the crate will be applied.

Since from the foregoing the construction and advantage of the device may be readily understood, further explanation is believed to be unnecessary.

However, since numerous modifications will readily occur to those skilled in the art after a consideration of the foregoing specification and accompanying drawings, it is not intended that the invention be limited to the exact construction shown and described, but all suitable modifications and equivalents may be resorted to which fall within the scope of the appended claims. Having described the invention,

What is claimed is:

1. A collapsible shipping crate comprising a base portion having vertical flanges extending from its outer edges, two inwardly folding side wall members and two inwardly folding end wall members, said wall members being attached to the respective upper edge portions of said vertical flanges, said wall members each having a hinge dividing the wall members into an upper and lower portion, the lower portions of said end wall members extending to a greater height than the lower portion of said wall members such that the upper end wall members fold and overlie the upper side wall members when the crate is in its collapsed position and a plurality of stops and latches located on the vertical edges of the upper wall portions for locking the wall members in an upright position when assembled, said wall members each having a plurality of plug means depending from the lower edges thereof, and respective complementary socket members in the upper edge portion of said vertical flanges receiving said plug means to affix said walls to said flanges.

2. The apparatus of claim 1 wherein each said hinge being of unitary construction with the respective said upper and lower wall member portions and extending the entire width of said wall member.

3. The apparatus of claim 2 wherein each said stop and associated latch comprises:

a first stop means including a pair of stop members disposed on the inner edge of each end wall member and adapted to engage an end rib portion of the side wall members from inward or outward movement when the crate is in the assembled condition;

a second stop means having a stop lug located on the inner edges of the end wall members, said stop lug adapted to contact the outer surface of the side wall member from outward movement when the crate is in the assembled condition;

a third stop means having a stop lug located on the inner edges of the end wall members, said stop lug adapted to contact the inner surface of the said wall members, thereby preventing said side wall members from inward movement when the crate is in the assembled condition; and a latch comprising a pair of snap fingers extending from the inner edges of the end wall members, said fingers adapted to engage a pair of cooperating sockets located on the vertical edges of the side wall members, said fingers and sockets cooperating to lock the wall members in an upright position.

4. The apparatus of claim 3 wherein the crate is constructed of resin material.

5. The apparatus of claim 4 wherein the resin material is polystyrene.

6. A collapsible crate, for shipping and storing fruit comprising a base portion having vertical flanges extending from its edges, two inwardly folding side wall members and two inwardly folding end wall members, cooperative plug and socket means affixing said wall members to the upper edge portion of said vertical flanges, said wall members each having a hinge in unitary construction therewith extending the entire width of said wall members and dividing each of said wall members into an upper portion and a lower portion, the lower portions of said end wall members extending to a greater height than the lower portion of said side wall members, said upper end wall members being foldable to overlie said upper side wall members when said crate is in its collapsed condition, and a plurality of respective complementary stops and latches disposed on the side edges of said upper wall portions for holding the wall members in a locked upright position when erected.

7. The apparatus of claim 6 wherein said crate is constructed of polystyrene.

* * * * *